US007928053B2

(12) United States Patent
Hecht et al.

(10) Patent No.: US 7,928,053 B2
(45) Date of Patent: Apr. 19, 2011

(54) MULTIPHASE CLEANING COMPOSITIONS HAVING IONIC LIQUID PHASE

(75) Inventors: Stacie Ellen Hecht, West Chester, OH (US); Kenneth Nathan Price, Wyoming, OH (US); Patricia Sara Berger, Cincinnati, OH (US); Peter Robert Foley, Cincinnati, OH (US); Howard David Hutton, III, Oregonia, OH (US); Michael Stanford Showell, Cincinnati, OH (US); Robb Richard Gardner, Cincinnati, OH (US); Raymond Louis Niehoff, Hamilton, OH (US); Kenneth Richard Seddon, Donaghadee (GB); Harambage Quintas Nimal Gunaratne, Belfast (GB); Martyn Earle, Belfast (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/471,763

(22) Filed: May 26, 2009

(65) Prior Publication Data

US 2009/0233829 A1 Sep. 17, 2009

Related U.S. Application Data

(62) Division of application No. 11/263,392, filed on Oct. 31, 2005.

(60) Provisional application No. 60/624,127, filed on Nov. 1, 2004.

(51) Int. Cl.
*C11D 17/00* (2006.01)

(52) U.S. Cl. ..... 510/407; 510/417; 510/424; 510/426; 510/499

(58) Field of Classification Search ..... None
See application file for complete search history.

(56) References Cited

U.S. PATENT DOCUMENTS

| | | | |
|---|---|---|---|
| 3,075,921 | A | 1/1963 | Brocklchurst et al. |
| 3,282,728 | A | 11/1966 | Lacroux et al. |
| 3,896,033 | A | 7/1975 | Grimm, III |
| 4,126,573 | A | 11/1978 | Johnston |
| 4,170,453 | A | 10/1979 | Kitko |
| 4,189,311 | A | 2/1980 | Laqua et al. |
| 4,348,292 | A | 9/1982 | Ginn |
| 4,606,838 | A | 8/1986 | Burns |
| 4,634,551 | A | 1/1987 | Burns et al. |
| 4,681,592 | A | 7/1987 | Hardy et al. |
| 4,689,168 | A | 8/1987 | Requejo |
| 4,717,507 | A | 1/1988 | Schwadtke et al. |
| 4,756,850 | A | 7/1988 | Nayar |
| 4,783,278 | A | 11/1988 | Sanderson et al. |
| 5,250,121 | A | 10/1993 | Yamamoto et al. |
| 5,290,475 | A | 3/1994 | Wixon |
| 5,476,660 | A | 12/1995 | Somasundaran et al. |
| 5,545,350 | A | 8/1996 | Baker et al. |
| 5,705,466 | A | 1/1998 | Baillely |
| 5,731,101 | A | 3/1998 | Sherif et al. |
| 5,798,329 | A | 8/1998 | Taylor et al. |
| 5,827,602 | A | 10/1998 | Koch et al. |
| 5,908,820 | A | 6/1999 | Oakes et al. |
| 6,048,388 | A | 4/2000 | Schwarz |
| 6,086,785 | A | 7/2000 | Roesler et al. |
| 6,165,448 | A | 12/2000 | Joiner et al. |
| 6,180,587 | B1 | 1/2001 | Fuller et al. |
| 6,274,539 | B1 | 8/2001 | Kacher et al. |
| 6,277,808 | B1 | 8/2001 | Tcheou et al. |
| 6,280,883 | B1 | 8/2001 | Lamanna et al. |
| 6,288,281 | B1 | 9/2001 | Nemeth et al. |
| 6,339,182 | B1 | 1/2002 | Munson et al. |
| 6,372,829 | B1 | 4/2002 | Lamanna et al. |
| 6,416,557 | B1 | 7/2002 | Ona et al. |
| 6,440,924 | B1 | 8/2002 | Jeschke et al. |
| 6,472,360 | B1 | 10/2002 | Beggs et al. |
| 6,479,446 | B1 | 11/2002 | Sherry et al. |
| 6,489,286 | B1 | 12/2002 | Lukenbach et al. |
| 6,521,584 | B1 | 2/2003 | Soldanski |
| 6,521,585 | B1 | 2/2003 | Yamashita et al. |
| 6,569,344 | B1 | 5/2003 | Hubesch et al. |
| 6,593,285 | B1 | 7/2003 | Scheibel et al. |
| 6,689,223 | B1 | 2/2004 | Meine et al. |
| 6,767,882 | B1 | 7/2004 | Jagannath et al. |
| 6,808,557 | B2 | 10/2004 | Holbrey et al. |
| 6,824,599 | B2 | 11/2004 | Swatloski |
| 6,900,313 | B2 | 5/2005 | Wasserscheid et al. |
| 2001/0014654 | A1 | 8/2001 | Davister et al. |
| 2002/0016269 | A1 | 2/2002 | Noda et al. |
| 2002/0133886 | A1 | 9/2002 | Severns et al. |
| 2002/0137657 | A1 | 9/2002 | Lant et al. |
| 2003/0027473 | A1 | 2/2003 | Kakiuchi et al. |
| 2003/0045440 | A1 | 3/2003 | Van der Hoeven et al. |
| 2003/0060378 | A1 | 3/2003 | Hsu et al. |

(Continued)

FOREIGN PATENT DOCUMENTS

| | | |
|---|---|---|
| CN | 1081629 | 3/2002 |

(Continued)

OTHER PUBLICATIONS

John S Wilks, Air and Water Stable 1-Ethyl-3-methylimidazolium Based Ionic Liquids, The rank J. Seller Research Laboratory, United States Air Force Academy, Colorado, US, 1992, pp. 965-967.
J D Holbrey, Clean Products and Processes (1999) pp. 223, 236.
Richard Swatloski, Dissolution of Cellose with Ionic Liquids, Center for Green Manufacturing and Department of Chemistry, the University of Alabama, (2002) pp. 4974-4975.
David Bradley, Super Solvents, Technology Ireland, Sep. 1999 pp. 47 & 48.

*Primary Examiner* — Necholus Ogden, Jr.
(74) *Attorney, Agent, or Firm* — Andrew J. Mueller; Leonard W. Lewis

(57) ABSTRACT

A multiphase cleaning composition comprises a first phase and a second ionic liquid phase, wherein the second phase is substantially immiscible with the first phase. The first phase may comprise, for example, an aqueous phase or a silicone solvent system. Methods of cleaning a soiled surface comprise contacting a soiled surface with a multiphase wash liquor including a first phase and a second ionic liquid phase, wherein the second phase is substantially immiscible with the first phase, and removing soils from the surface.

16 Claims, No Drawings

U.S. PATENT DOCUMENTS

| | | | |
|---|---|---|---|
| 2003/0109405 | A1 | 6/2003 | Kellar et al. |
| 2003/0119709 | A1 | 6/2003 | Scheper |
| 2003/0139312 | A1 | 7/2003 | Caswell et al. |
| 2004/0005286 | A1 | 1/2004 | Giroud |
| 2004/0007693 | A1 | 1/2004 | Moulton et al. |
| 2004/0035293 | A1 | 2/2004 | Davis, Jr. |
| 2004/0054231 | A1 | 3/2004 | Abbott et al. |
| 2004/0077519 | A1 | 4/2004 | Price et al. |
| 2004/0096932 | A1 | 5/2004 | Kragl et al. |
| 2004/0097755 | A1 | 5/2004 | Abbott et al. |
| 2004/0133058 | A1 | 7/2004 | Arlt et al. |
| 2004/0142840 | A1 | 7/2004 | de Buzzaccarini et al. |
| 2004/0167265 | A1 | 8/2004 | Thompson et al. |
| 2004/0198629 | A1 | 10/2004 | Raehse et al. |
| 2004/0198902 | A1 | 10/2004 | Yui et al. |
| 2005/0143269 | A1 | 6/2005 | Wei et al. |
| 2006/0079418 | A1 | 4/2006 | Wagner et al. |
| 2006/0079421 | A1 | 4/2006 | Wagner et al. |
| 2006/0090777 | A1 | 5/2006 | Hecht et al. |
| 2006/0094615 | A1 | 5/2006 | Hecht et al. |
| 2006/0094616 | A1 | 5/2006 | Hecht et al. |
| 2006/0094617 | A1 | 5/2006 | Price et al. |
| 2006/0094620 | A1 | 5/2006 | Jordan, IV et al. |
| 2006/0094621 | A1 | 5/2006 | Jordan, IV et al. |
| 2006/0166856 | A1 | 7/2006 | Petrat et al. |
| 2006/0240727 | A1 | 10/2006 | Price et al. |
| 2006/0240728 | A1 | 10/2006 | Price et al. |

FOREIGN PATENT DOCUMENTS

| | | | |
|---|---|---|---|
| DE | 3 740 899 | | 6/1989 |
| DE | 101 37 047 | A1 | 2/2003 |
| EP | 0 267 175 | | 5/1988 |
| EP | 0 334 427 | | 9/1989 |
| EP | 0 723 006 | A | 7/1996 |
| EP | 0 895 777 | | 2/1999 |
| EP | 1 222 865 | | 7/2002 |
| EP | 1 454 978 | A | 9/2004 |
| FR | 1296756 | | 5/1962 |
| FR | 2 101 710 | A | 3/1972 |
| GB | 1 014 539 | A | 12/1965 |
| GB | 1 269 677 | | 4/1972 |
| JP | 3064368 | | 3/1991 |
| JP | 5178798 | | 7/1993 |
| JP | 06009767 | A2 | 1/1994 |
| JP | 10265674 | | 6/1998 |
| JP | 11084603 | A2 | 3/1999 |
| JP | 2915208 | B2 | 7/1999 |
| WO | WO 96/05802 | | 2/1996 |
| WO | WO 98/32822 | | 7/1998 |
| WO | WO 98/55581 | A | 12/1998 |
| WO | WO 00/01793 | A | 1/2000 |
| WO | WO 01/19200 | A1 | 3/2001 |
| WO | WO 01/77486 | A1 | 10/2001 |
| WO | WO 02/34722 | A1 | 5/2002 |
| WO | WO 02/38784 | | 5/2002 |
| WO | WO 02/50366 | A1 | 6/2002 |
| WO | WO 03/002702 | | 1/2003 |
| WO | WO 03/057871 | A1 | 7/2003 |
| WO | WO 03/074494 | A1 | 9/2003 |
| WO | WO 2004/022670 | A1 | 3/2004 |
| WO | WO 2004/035018 | A2 | 4/2004 |
| WO | WO 2004/067739 | A2 | 8/2004 |

MULTIPHASE CLEANING COMPOSITIONS HAVING IONIC LIQUID PHASE

CROSS REFERENCE TO RELATED APPLICATIONS

This application is a divisional of and claims priority under 35 U.S.C. §120 to U.S. patent application Ser. No. 11/263,392, filed Oct. 31, 2005, which in turn claims priority under 35 U.S.C. §119(e) to U.S. Provisional Application Ser. No. 60/624,127, filed on Nov. 1, 2004.

FIELD OF THE INVENTION

The present invention is directed to multiphase cleaning compositions comprising a first phase and a second ionic liquid phase, wherein the second phase is substantially immiscible with the first phase. The invention is also directed to cleaning methods employing such compositions, particularly in a bulk cleaning environment.

BACKGROUND OF THE INVENTION

In recent years, ionic liquids have been extensively evaluated as environmental-friendly or "green" alternatives to conventional organic solvents for a broad range of organic synthetic applications. Ionic liquids offer some unique characteristics that distinguish them from conventional organic solvents, such as no effective vapor pressure, a broad liquid range, high polarity and charge density, can be either hydrophobic or hydrophilic, and unique solvating properties. One widely studied class of ionic liquids includes imidazolium salts, such as 1-butyl-3-methylimidazolium hexafluorophosphate, also known as [bmim][$PF_6$]. Other well known ionic liquids include 1-ethyl-3-methylimidazolium chloride-aluminium (III) chloride, which is usually referred to as [emim]Cl—$AlCl_3$; and N-butyl pyridinium chloride aluminium (III) chloride, which is usually referred to as [Nbupy]Cl—$AlCl_3$. A broad range of ionic liquids have also been investigated in the following references: U.S. Pat. No. 6,048,388; U.S. Pat. No. 5,827,602; U.S. Patent Publications: US 2003/915735A1; US 2004/0007693A1; US 2004/0035293A1; and PCT publications: WO 02/26701; WO 03/074494; WO 03/022812; WO 04/016570. Published PCT Application WO 2004/003120 discloses ionic liquid based products suitable for use in surface or air treating compositions, and ionic liquid cocktails containing three or more different and charged ionic liquid components. The products are particularly useful in various consumer product applications, such as home care, air care, surface cleaning, laundry and fabric care applications.

It is desirable to take advantage of the various unique characteristics of the ionic liquid in cleaning products to improved cleaning performance. Specifically, compositions containing ionic liquids, more specifically, biphasic or multiphasic compositions containing ionic liquids are advantageous in delivering superior cleaning performance. Additionally, it is desirable to provide a cleaning method capable of delivering improved cleaning performance through the use of ionic liquid-containing compositions. These compositions and methods are advantageous in that they provide cleaning benefits while employing materials recognized as environmentally friendly. These and additional objects and advantages will be more fully apparent in view of the following detailed description.

SUMMARY OF THE INVENTION

In one embodiment, the invention is directed to a multiphase cleaning composition which comprises a first phase and a second ionic liquid phase. The second phase is substantially immiscible with the first phase. The first phase may be an aqueous phase or a silicone solvent phase.

In another embodiment, the invention is directed to methods of cleaning a soiled surface. The methods comprise contacting a soiled surface with a multiphase wash liquor including a first liquid phase and a second ionic liquid phase, wherein the second phase is substantially immiscible with the first phase, and removing soils from the surface.

Additional embodiments of the compositions and methods of the invention are described in further detail in the following detailed description.

DETAILED DESCRIPTION OF THE INVENTION

The cleaning compositions and methods according to the present invention may be used for cleaning hard surfaces, for example, including but not limited to, household hard surfaces (such as kitchen surfaces, bathroom surfaces, floors, windows, mirrors and countertops), car hard surfaces (such as automobile interiors, automobile exteriors, metal surfaces and windshields), and other personal or household articles (such as dishware, cookware, utensils, tableware and glassware), textile surfaces, for example, including, but not limited to, carpets, fabrics (such as woven textiles, nonwoven textiles, knitted textiles and the like, in the form of upholstery, drapes, garments, and/or linens), and/or other soiled surfaces.

The compositions and methods according to the present invention may be used for treating and/or cleaning air, typically in an enclosed area.

The multiphase cleaning compositions comprise a first liquid phase and a second ionic liquid phase. The first phase may comprise a liquid carrier, for example water, an organic solvent, or combinations thereof. In some embodiments, the liquid carrier of the first phase is water. In alternate embodiments, the liquid carrier of the first phase is a silicone solvent system comprising at least about 50 wt % silicones and optionally, other lipophilic fluids such as hydrocarbons, halocarbons, glycol ethers, diols. Silicones include linear or cyclic silicones, including decamethyl cyclopentasiloxane (D5). Such lipophilic fluid carriers are particularly suitable for dry-cleaning applications, both in commercial and in-home dry-cleaning methods. Typically, the liquid carrier of the first phase will be present in amounts of from about 1 to about 99% by weight of the composition, preferably from about 5 to about 95% by weight of the composition, more preferable from about 20 to about 80% by weight of the composition.

The compositions comprising an aqueous phase may optionally include a co-solvent. Typical examples of co-solvents include, but are not limited to, linear or branched C1-C10 alcohols, diols, and mixtures thereof. In specific embodiments, co-solvents such as ethanol, isopropanol, and propylene glycol are used in some of the compositions of the present invention. In additional specific embodiments, the ionic liquid phase is substantially free of free water and/or other organic solvents. These compositions can contain less than about 10 weight percent, more specifically less than about 5 weight percent, even more specifically less than about 1 weight percent, free water and/or other organic solvents.

The composition may also comprise, optionally, a phase stabilizing surfactant capable of stabilizing the phases. Exemplary surfactants suitable for this use include decaglycerol decaoleate, sorbitan esters (Span® from Uniqema), polyoxyethylene derivatives of sorbitan esters (Tween® from Uniqema), and block copolymer surfactants (Pluronic® from BASF Corporation). These compositions can contain less than about 10 weight percent, more specifically less than about 5 weight percent, even more specifically less than about 1 weight percent, phase stabilizing surfactants.

Ionic liquid as used herein refers to a salt that is in a liquid form at room temperature, typically about 20-25° C. Typically, an ionic liquid has a melting temperature of about 100° C. or less, alternatively of about 60° C. or less, or in a further alternative, of about 40° C. or less. In other embodiments, the ionic liquids exhibit no discernible melting point (based on DSC analysis) but are "flowable" at a temperature of about 100° C. or below, or, in another embodiment, are "flowable" at a temperature of from about 20 to about 80° C., i.e., the typical fabric or dish washing temperatures. As used herein, the term "flowable" means that the ionic liquid exhibits a viscosity of less than about 10,000 mPa·s at the temperatures as specified above.

It should be understood that the terms "ionic liquid", "ionic compound", and "IL" refer to ionic liquids, ionic liquid composites, and mixtures (or cocktails) of ionic liquids. The ionic liquid can comprise an anionic IL component and a cationic IL component. When the ionic liquid is in its liquid form, these components may freely associate with one another (i.e., in a scramble). As used herein, the term "cocktail of ionic liquids" refers to a mixture of two or more, preferably at least three, different and charged IL components, wherein at least one IL component is cationic and at least one IL component is anionic. Thus, the pairing of three cationic and anionic IL components in a cocktail would result in at least two different ionic liquids. The cocktails of ionic liquids may be prepared either by mixing individual ionic liquids having different IL components, or by preparing them via combinatorial chemistry. Such combinations and their preparation are discussed in further detail in US 2004/0077519A1 and US 2004/0097755A1. As used herein, the term "ionic liquid composite" refers to a mixture of a salt (which can be solid at room temperature) with a proton donor Z (which can be a liquid or a solid) as described in the references immediately above. Upon mixing, these components turn into a liquid at about 100° C. or less, and the mixture behaves like an ionic liquid.

Nonlimiting examples of anions and cations suitable for use in the ionic liquids for the present invention are discussed in further detail.

Anions

Anions suitable for use in the ionic liquids of the present invention include, but are not limited to, the following materials:

(1) Alkyl sulfates (AS), alkoxy sulfates and alkyl alkoxy sulfates, wherein the alkyl or alkoxy is linear, branched or mixtures thereof; furthermore, the attachment of the sulfate group to the alkyl chain can be terminal on the alkyl chain (AS), internal on the alkyl chain (SAS) or mixtures thereof: nonlimiting examples include linear $C_{10}$-$C_{20}$ alkyl sulfates having formula:

$$CH_3(CH_2)_{x+y}CH_2OSO_3^-M^+$$

wherein x+y is an integer of at least 8, preferably at least about 10; $M^+$ is a cation selected from the cations of the ionic liquids as described in detail herein; or linear $C_{10}$-$C_{20}$ secondary alkyl sulfates having formula:

$$CH_3(CH_2)_x(\overset{\overset{\displaystyle OSO_3^-M^+}{|}}{C}H)(CH_2)_yCH_3$$

wherein x+y is an integer of at least 7, preferably at least about 9; x or y can be 0, $M^+$ is a cation selected from the cations of the ionic liquids as described in detail herein; or C10-C20 secondary alkyl ethoxy sulfates having formula:

$$CH_3(CH_2)_x(\overset{\overset{\displaystyle O(CH_2CH_2O)_2SO_3^-M^+}{|}}{C}H)(CH_2)_yCH_3$$

wherein x+y is an integer of at least 7, preferably at least about 9; x or y can be 0, $M^+$ is a cation selected from the cations of the ionic liquids as described in detail herein; nonlimiting examples of alkoxy sulfate include sulfated derivatives of commercially available alkoxy copolymers, such as Pluronics® (from BASF);

(2) Mono- and di-esters of sulfosuccinates: nonlimiting examples include saturated and unsaturated $C_{12-18}$ monoester sulfosuccinates, such as lauryl sulfosuccinate available as Mackanate LO-100® (from The McIntyre Group); saturated and unsaturated $C_6$-$C_{12}$ diester sulfosuccinates, such as dioctyl ester sulfosuccinate available as Aerosol OT® (from Cytec Industries, Inc.);

(3) Methyl ester sulfonates (MES);

(4) Alkyl aryl sulfonates, nonlimiting examples include tosylate, alkyl aryl sulfonates having linear or branched, saturated or unsaturated $C_8$-$C_{14}$ alkyls; alkyl benzene sulfonates (LAS) such as $C_{11}$-$C_{18}$ alkyl benzene sulfonates; sulfonates of benzene, cumene, toluene, xylene, t-butylbenzene, di-isopropylbenzene, or isopropylbenzene; naphthalene sulfonates and $C_{6-14}$ alkyl naphthalene sulfonates, such as Petro® (from Akzo Nobel Surface Chemistry); sulfonates of petroleum, such as Monalube 605® (from Uniqema);

(5) Alkyl glycerol ether sulfonates having 8 to 22 carbon atoms in the alkyl moiety;

(6) Diphenyl ether (bis-phenyl) derivatives: Nonlimiting examples include triclosan (2,4,4'-trichloro-2'-hydroxydiphenyl ether) and diclosan (4,4'-dichloro-2-hydroxydiphenyl ether), both are available as Irgasan® from Ciba Specialty Chemicals;

(7) Linear or cyclic carboxylates: nonlimiting examples include citrate, lactate, tartarate, succinate, alkylene succinate, maleate, gluconate, formate, cinnamate, benzoate, acetate, salicylate, phthalate, aspartate, adipate, acetyl salicylate, 3-methyl salicylate, 4-hydroxy isophthalate, dihydroxyfumarate, 1,2,4-benzene tricarboxylate, pentanoate and mixtures thereof;

(8) Mid-chain branched alkyl sulfates (HSAS), mid-chain branched alkyl aryl sulfonates (MLAS) and mid-chain branched alkyl polyoxyalkylene sulfates; nonlimiting examples of MLAS are disclosed in U.S. Pat. No. 6,596,680; U.S. Pat. No. 6,593,285; and U.S. Pat. No. 6,202,303;

(9) Sarcosinates having the general formula $RCON(CH_3)CH_2CO_2^-$, wherein R is an alkyl from about $C_{8-20}$; nonlimiting examples include ammonium lauroyl sarcosinate, available as Hamposyl AL-30® from Dow Chemicals and sodium oleoyl sarcosinate, available as Hamposyl O® from Dow Chemical;

(10) Sulfated and sulfonated oils and fatty acids, linear or branched, such as those sulfates or sulfonates derived from potassium coconut oil soap available as Norfox 1101® from Norman, Fox & Co. and Potassium oleate from Chemron Corp.;

(11) Fatty acid ester sulfonates having the formula:

$$R^1—CH(SO_3^-)CO_2R^2$$

wherein $R^1$ is linear or branched $C_8$ to $C_{18}$ alkyl, and $R^2$ is linear or branched $C_1$ to $C_6$ alkyl;

(12) Sweetener derived anions: saccharinate and acesulfamate;

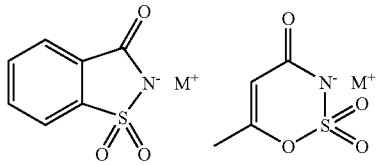

saccharinate acesulfamate wherein M+ is a cation selected from the cations of the ionic liquids as described herein;

(13) Ethoxylated amide sulfates; sodium tripolyphosphate (STPP); dihydrogen phosphate; fluoroalkyl sulfonate; bis-(alkylsulfonyl) amine; bis-(fluoroalkylsulfonyl)amide; (fluoroalkylsulfonyl)(fluoroalkylcarbonyl)amide; bis(arylsulfonyl)amide; carbonate; tetrafluorborate ($BF_4^-$); hexafluorophosphate ($PF_6^-$);

(14) Anionic bleach activators having the general formula:

$$R^1—CO—O—C_6H_4—R^2$$

wherein $R^1$ is $C_8$-$C_{18}$ alkyl, $C_8$-$C_{18}$ amino alkyl, or mixtures thereof, and $R^2$ is sulfonate or carbonate; nonlimiting examples such as:

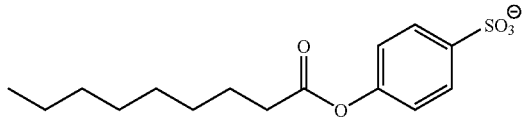

4-nonanoyloxybenzene sulfonate

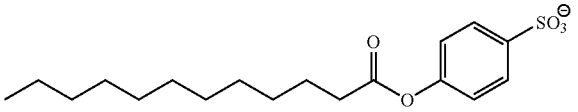

4-dodecanoyloxybenzene sulfonate

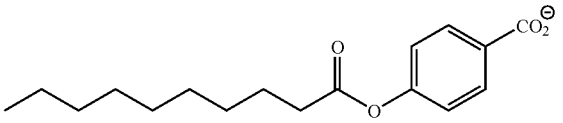

4-decanoyloxybenzoate are disclosed in U.S. Pat. No. 5,891,838; U.S. Pat. No. 6,448,430; U.S. Pat. No. 5,891,838; U.S. Pat. No. 6,159,919; U.S. Pat. No. 6,448,430; U.S. Pat. No. 5,843,879; U.S. Pat. No. 6,548,467.

Cations

Cations suitable for use in the ionic liquids of the present invention include, but are not limited to, the following materials:

(a) Cations (i.e., in the protonated, cationic form) of amine oxides, phosphine oxides, or sulfoxides: nonlimiting examples include amine oxide cations containing one $C_{8-18}$ alkyl moiety and 2 moieties selected from the group consisting of $C_{1-3}$ alkyl groups and $C_{1-3}$ hydroxyalkyl groups; phosphine oxide cations containing one $C_{10-18}$ alkyl moiety and 2 moieties selected from the group consisting of $C_{1-3}$ alkyl groups and $C_{1-3}$ hydroxyalkyl groups; and sulfoxide cations containing one $C_{10-18}$ alkyl moiety and a moiety selected from the group consisting of $C_{1-3}$ alkyl and $C_{1-3}$ hydroxyalkyl moieties; in some embodiments, the amine oxide cations have the following formula:

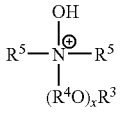

wherein $R^3$ is an $C_{8-22}$ alkyl, $C_{8-22}$ hydroxyalkyl, $C_{8-22}$ alkyl phenyl group, and mixtures thereof; $R^4$ is an $C_{2-3}$ alkylene or $C_{2-3}$ hydroxyalkylene group or mixtures thereof; x is from 0 to about 3; and each $R^5$ is independently an $C_{1-3}$ alkyl or $C_{1-3}$ hydroxyalkyl group or a polyethylene oxide group containing an average of from about 1 to about 3 ethylene oxide groups; the $R^5$ groups may be attached to each other, e.g., through an oxygen or nitrogen atom, to form a ring structure; other exemplary amine oxide cations include $C_{10}$-$C_{18}$, $C_{10}$, $C_{10}$-$C_{12}$, and $C_{12}$-$C_{14}$ alkyl dimethyl amine oxide cations, and $C_8$-$C_{12}$ alkoxy ethyl dihydroxy ethyl amine oxide cations;

(b) Betaines having the general formula:

$$R—N^{(+)}(R^1)_2—R^2COOH$$

wherein R is selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring treated as equivalent to about 2 carbon atoms, and similar structures interrupted by amido or ether linkages; each $R^1$ is an alkyl group containing from 1 to about 3 carbon atoms; and R is an alkylene group containing from 1 to about 6 carbon atoms; nonlimiting examples of betaines include dodecyl dimethyl betaine, acetyl dimethyl betaine, dodecyl amidopropyl dimethyl betaine, tetradecyl dimethyl betaine, tetradecyl amidopropyl dimethyl betaine, dodecyl dimethyl ammonium hexanoate; and amidoalkylbetaines which are disclosed in U.S. Pat. Nos. 3,950,417; 4,137,191; and 4,375,421; and British Patent GB No. 2,103,236; in another embodiment, the cation may be a sulfobetaine, which are disclosed in U.S. Pat. No. 4,687,602;

(c) Diester quaternary ammonium (DEQA) cations of the type:

$$R_{(4-m)}—N^+—[(CH_2)_n—Y—R^1]_m$$

wherein each R substituent is selected from hydrogen; $C_1$-$C_6$ alkyl or hydroxyalkyl, preferably methyl, ethyl, propyl, or hydroxyethyl, and more preferably methyl; poly($C_1$-$C_3$ alkoxy), preferably polyethoxy; benzyl; or a mixture thereof; m is 2 or 3; each n is from 1 to about 4; each Y is —O—(O)C—, —C(O)—O—, —NR—C(O)—, or —C(O)—NR—; with the proviso that when Y is —O—(O)C— or —NR—C(O)—, the sum of carbons in each $R^1$ plus one is $C_{12}$-$C_{22}$, preferably $C_{14}$-$C_{20}$, with each $R^1$ being a hydrocarbyl, or substituted hydrocarbyl group; in one embodiment, the DEQA cation is an alkyl dimethyl hydroxyethyl quaternary ammonium as discussed in U.S. Pat. No. 6,004,922; in another embodiment, the DEQA cation has the general formula:

$$R^3N^+CH_2CH(YR^1)(CH_2YR^1)$$

wherein each Y, R, $R^1$ have the same meanings as before; in yet another embodiment, the DEQA cation is $[CH_3]_3N^{(+)}[CH_2CH(CH_2O(O)CR^1)O(O)CR^1]$ wherein each $R^1$ is in the range of $C_{15}$ to $C_{19}$;

(d) Alkylene quaternary ammonium cations having the formula:

$$R_{(4-m)}—N^+—R^1_m$$

wherein each m is 2 or 3; each R is independently an alkyl or hydroxyalkyl $C_1$-$C_6$ moiety, preferably methyl, ethyl, propyl or hydroxyethyl, and more preferably methyl; each $R^1$ is independently a linear or branched, saturated or unsaturated $C_6$-$C_{22}$ alkyl or alkoxy moiety, preferably $C_{14}$-$C_{20}$ moiety, but no more than one $R^1$ being less than about $C_{12}$ and then the other $R^1$ is at least about $C_{16}$; or hydrocarbyl or substituted hydrocarbyl moiety, preferably $C_{10}$-$C_{20}$ alkyl or alkenyl, most preferably $C_{12}$-$C_{18}$ alkyl or alkenyl; in one embodiment, the cation is dialkylenedimethyl ammonium, such as dioleyldimethyl ammonium available from Witco Corporation under the tradename Adogen® 472; in another embodiment, the cation monoalkenyltrimethyl ammonium, such as monooleyltrimethyl ammonium, monocanolatrimethyl ammonium, and soyatrimethyl ammonium;

(e) Difatty amido quaternary ammonium cations such as:

$$[R^1—C(O)—NR—R^2—N(R)_2—R^3—NR—C(O)—R^1]^+$$

wherein R and $R^1$ are as defined in cation (e) above, $R^2$ and $R^3$ are $C_1$-$C_6$ alkylene moieties; for example, difatty amido quats are commercially available from Witco under the Varisoft® tradename;

(f) $C_{8-22}$ quaternary surfactants such as isostearyl ethyl imidonium available in its ethosulfate salt form as Schercoquat IIS® from Scher Chemicals, Inc., quaternium-52 obtainable as Dehyquart SP® from Cognis Corporation, and dicoco dimethyl ammonium available in its chloride salt form as Arquad 2C-75® from Akzo Nobel Surface Chemistry LLC;

(g) Cationic esters such as discussed in U.S. Pat. No. 4,228,042, U.S. Pat. No. 4,239,660, U.S. Pat. No. 4,260,529 and U.S. Pat. No. 6,022,844;

(h) 4,5-dichloro-2-n-octyl-3-isothiazolone, which is obtainable as Kathon® from Rohm and Haas;

(i) Quaternary amino polyoxyalkylene derivatives (choline and choline derivatives);

(j) Alkyl oxyalkylene cations;

(k) Alkoxylate quaternary ammoniums (AQA) as discussed in U.S. Pat. No. 6,136,769;

dinium, indazolium, quinuclidinium, triazolium, isoquinuclidinium, piperidinium, morpholinium, pyridazinium, pyrazinium, triazinium, azepinium, diazepinium, pyridinium, piperidonium, pyrimidinium, thiophenium; phosphonium; in one embodiment, the cation is an substituted imidazolium cation having the formula:

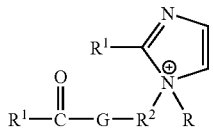

wherein each R and $R^1$ are as defined in cation (e) above; each $R^2$ is a $C_1$-$C_6$ alkylene group, preferably an ethylene group; and G is an oxygen atom or an —NR— group; for example, the cation 1-methyl-1-oleylamidoethyl-2-oleylimidazolinium is available commercially from the Witco Corporation under the trade name Varisoft® 3690; in another embodiment, the cation is alkylpyridinium cation having the formula:

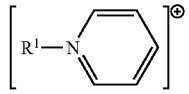

wherein $R^1$ is an acyclic aliphatic $C_8$-$C_{22}$ hydrocarbon group; in another embodiment, the cation is an alkanamide alkylene pyridinium cation having the formula:

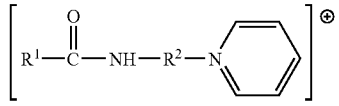

wherein $R^1$ is a linear or branched, saturated or unsaturated $C_6$-$C_{22}$ alkyl or alkoxy moiety, or a hydrocarbyl or substituted hydrocarbyl moiety, and $R^2$ is a $C_1$-$C_6$ alkylene moiety;

(m) Cationic bleach activators having a quaternary ammonium moiety including but not limited to

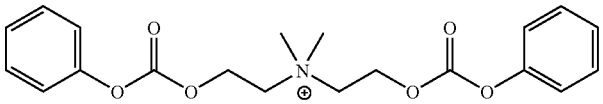

N, N-dimethyl-2-[(phenoxycarbonyl)oxy]-N-[2-[(phenoxycarbonyl)oxy]ethyl]ethanaminium

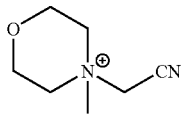

4-(cyanomethyl)-4-methylmorpholinium;

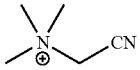

1-cyano-N,N,N-trimethylmethanaminium

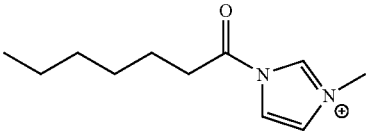

1-methyl-3-(1-oxoheptyl)-1H-Imidazolium (l) Substituted and unsubstituted pyrrolidinium, imidazolium, benzimidazolium, pyrazolium, benzpyrazolium, thiazolium, benzthiazolium, oxazolium, benzoxazolium, isoxazolium, isothiazolium, imdazolidenium, Guanithese and other cationic bleach activators suitable for use herein as cations of the ionic liquids are disclosed in U.S. Pat. No. 5,599,781, U.S. Pat. No. 5,686,015, U.S. Pat. No. 5,686,015, WO 95/29160, U.S. Pat. No. 5,599,781, U.S. Pat. No. 5,534,179, EP 1 253 190 A1, U.S. Pat. No. 6,183,665, U.S. Pat. No. 5,106,528, U.S. Pat. No. 5,281, 361, and Bulletin de la Societe Chimique de France (1973), (3)(Pt. 2), 1021-7;

(n) Cationic anti-microbial agents, such as cetyl pyridinium, chlorohexidine and domiphen.

(o) Alkylated caffeine cations, such as

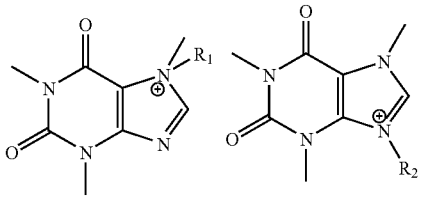

wherein $R_1$ and $R_2$ are C1 to C12 alkyl or alkylene groups.

In some specific embodiments, water immiscible ionic liquids comprise cations having the formulae:

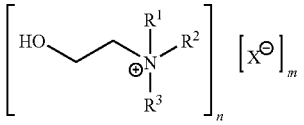

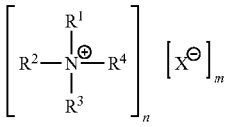

wherein $R^1$-$R^4$ are selected from among the group consisting of linear or branched, substituted or unsubstituted, alkyl, aryl, alkoxyalkyl, alkylenearyl hydroxyalkyl, or haloalkyl; X is an anion such as those described hereinabove; m and n are chosen to provide electronic neutrality; further wherein the ionic liquids are water immiscible when at least one of $R^1$-$R^4$ is C12 or higher; or at least two of $R^1$-$R^4$ are C10 or higher; or at least three of $R^1$-$R^4$ are C6 or higher. In further embodiments, the water immiscible ionic liquids comprise a cation selected from the group consisting of trimethyloctyl ammonium cation, triisooctylmethyl ammonium cation, tetrahexyl ammonium cation, tetraoctyl ammonium cation, and mixtures thereof, and an anion selected from those described hereinabove. In yet further embodiments, the water immiscible ionic liquids comprise amine oxide cations and an anion selected from those described hereinabove. In additional embodiments, the water immiscible ionic liquids comprise betaine cations and an anion selected from those described hereinabove.

Thus, the ionic liquids suitable for use herein may have various anionic and cationic combinations. The ionic species can be adjusted and mixed such that properties of the ionic liquids can be customized for specific applications, so as to provide the desired solvating properties, viscosity, melting point, and other properties, as desired. These customized ionic liquids have been referred to as "designer solvents".

Examples of ionic liquids that are useful in the present invention are described in U.S. Pat. No. 6,048,388; U.S. Pat. No. 5,827,602; US 2003/915735A1; US 2004/0007693A1; US 2004/003120; US 2004/0035293A1; WO 02/26701; WO 03/074494; WO 03/022812; WO 04/016570; and co-filed P&G Case 9817P and 9818P.

The ionic liquid can be present in the cleaning compositions disclosed herein in any desired effective amount. Typically, the ionic liquid is present in an amount ranging from about 0.1% to about 99.9%, preferably from about 1% to about 75%, and more preferably from about 1% to about 60%, by weight of the composition. In some embodiments, the second ionic liquid phase comprises less than about 50% by weight of the composition. In yet additional embodiments, the second ionic liquid phase comprises less than about 10% by weight of the composition.

As previously indicated, the ionic liquid phase is substantially immiscible with the first phase, as determined according to the following Ionic Liquid Water Miscibility Test:

A mixture of 0.5 g ionic liquid and 4.5 g de-ionized water are sonicated in a Bransonic Ultrasonic Bath, model no. 1210R-MTH, 50/60 Hz, 117 volts, 1.3 AMPS, according to the manufacturer's specifications for 1.5 hours. Thereafter, if a homogenous transparent system results within 15 minutes of standing without agitation, then the ionic liquid is water miscible.

In specific embodiments of the multiphase compositions, the immiscibility among phases would mean that one phase is substantially free of any carrier liquid of the other phase. For example, if the first phase is an aqueous phase, the second phase is substantially free of water and water-miscible organic solvents. Similarly, if the first phase comprises a silicone solvent system, the second phase is substantially free of silicone carrier. As used herein, "substantially free of" indicates that the phase contains less than about 10 weight %, more preferably less than about 5 weight %, even more preferably less than about 1 weight %, of the recited component.

The respective phases may be in the form of discrete liquid layers or dispersed domains (e.g., droplets, particles, stripes, and other shapes) of one phase dispersed in another phase. In a specific embodiment, the second phase is dispersed in the first phase. In a more specific embodiment, the second phase comprises droplets dispersed in the first phase. The droplets may be of any size, depending on various desired functional capabilities, as subsequently discussed in detail. In a specific embodiment, the dispersed second phase comprises droplets having an average droplet size of less than about 1,000 microns, or in other embodiments, less than about 250 microns or less than about 100 microns. In further embodiments, the composition is a clear liquid because any dispersed phase therein has a dimension less than the wavelength of visible light. In the embodiment where ionic liquid is the dispersed phase, the small phase dimension of the dispersed ionic liquid phase may enable better contact between soils and the ionic liquid phase. In still other embodiments, the composition comprises a high internal phase emulsion wherein the dispersed phase (either the ionic liquid-containing phase or the carrier-containing phase) comprises greater than 50 wt % of the composition.

By providing a multiphase composition, the ionic liquid is available for providing unexpected improvements to the cleaning compositions. Not intending to be bound by theory, it is believed that the high charge, high polarity of the ionic liquids enable the ionic liquid to interact strongly with soils, thereby removing soils from surfaces being treated, and/or extracting soils from other phases of the composition. It is also believed that due to the strong interactions between them, the ionic liquid may function as a trap for removed soils, particularly greasy soils, and therefore act as a microsponge. The ability to trap soils is particularly advantageous in preventing redeposition of removed soils. As will be appreciated, by entrapping greasy soils in the ionic liquid-containing phase, a bulk aqueous phase such as sink water in a hand dishwashing operation will remain acceptable to a consumer for continued washing for a longer period of time as the grease is captured in the ionic liquid. Thus, the compositions may be used to improve wash water appearance in hand dishwashing applications, thereby delivering cleaner-looking wash water.

The present compositions are also advantageous in that the ionic liquid may provide improved direct-contact mediated stain removal, hydration, and/or softening, particularly on tough soils, for example tough food soils such as burnt-on and/or baked-on foods, polymerized grease and the like. This advantage may be particularly apparent in compositions wherein the second phase is dispersed throughout the first phase, thereby increasing the surface contact during use of the composition in a cleaning operation. The unique polarity charges of the ionic liquid provide improved solvating properties for some soils. In specific embodiments, the ionic liquid may provide improved solvating properties for soils that are difficult to remove using conventional cleaning composition, including, but not limited to, hydrophobic soils which are often difficult to clean using water-based cleaning compositions. While not intending to be bound by theory, such soils may preferentially interact with or migrate into the ionic liquid phase.

In another aspect, the ionic liquid phase may provide a sequestered location for additional components of the cleaning compositions. For example, the ionic liquid phase can provide a sequestered reaction location for components such as bleaches, bleach catalysts, enzymes or the like. Further, the ionic liquid may be selected to enhance such reactions. The ionic liquid may also provide a stable environment which increases the stability of the component within the composition, for example during manufacture and/or storage and/or use. Additionally, the ionic liquid may serve merely as a carrier for delivery of such agents, and/or additional benefit agents.

Suitable benefit agents include, but are not limited to, one or more agents selected from the group consisting of bleaches, bleach catalysts, bleach boosters, bleach activators, suds suppressors, particulate builders (e.g., silica, zeolites, phosphates), polymeric builders (e.g., polyacrylates, poly (acrylic-maeic) copolymers), chelants, biocides, surfactants, enzymes, radical initiators, perfumes, dyes, skin conditioning actives, vitamins, softeners, and mixtures thereof. In a specific embodiment, the compositions further comprise a soil dispersing agent. Such agents are well known in the art to reduce redeposition of removed soils on articles which are subjected to a cleaning procedure. Suitable soil dispersing agents are well known in the art and examples include, but are not limited to, clays, soil release polymers, detersive surfactants, mixtures thereof.

Additional examples of suitable benefit agents are disclosed in U.S. Pat. No. 6,488,943, Beerse et al.; U.S. Pat. No. 6,514,932, Hubesch et al.; U.S. Pat. No. 6,548,470, Buzzaccarini et al.; U.S. Pat. No. 6,482,793, Gordon et al.; U.S. Pat. No. 5,545,350, Baker et al.; U.S. Pat. No. 6,083,899, Baker et al.; U.S. Pat. No. 6,156,722, Panandiker et al.; U.S. Pat. No. 6,573,234, Sivik et al.; U.S. Pat. No. 6,525,012, Price et al.; U.S. Pat. No. 6,551,986, Littig et al.; U.S. Pat. No. 6,566,323, Littig et al.; U.S. Pat. No. 6,090,767, Jackson et al.; and/or U.S. Pat. No. 6,420,326, Maile et al.

The benefit agents may be included in the cleaning composition in any desired amount. Typical compositions may contain from about 0.001 to about 20 percent by weight of the composition, of the benefit agent. In more specific embodiments, such compositions may comprise from about 0.01 to about 10 percent by weight, and more specifically, from about 0.1 to about 5 percent by weight, of the benefit agent(s).

The benefit agents may be included in the ionic liquid-containing phase, however, it is equally within the scope of the present invention to include one or more, or all of any such benefit agents, in a phase other than the ionic liquid-containing phase. Thus, such benefit agents may be contained in the first phase and/or additional phases of the composition.

In one embodiment, the composition includes an ionic liquid phase, wherein the benefit agent is in the form of an ionic liquid active. An ionic liquid active is composed of an ion active and an ionic liquid-forming counter ion, wherein the ion active provides benefit to the surfaces treated by the cleaning composition. The ionic active may be anionic or cationic, as necessary for the desired benefit, and is typically derived from a salt or acid of a known active agent. For example, if a conventional active agent in salt form is of the formula $X^+Y^-$ and the anion $Y^-$ provides the desired benefit activity, then the anionic form of the active agent is employed in the ionic liquid active. Examples of suitable anionic actives include, but are not limited to, anionic phosphate builders, anionic linear alkyl sulfate and sulfonate detersive surfactants, anionic alkylated and alkoxylated sulfate and sulfonate detersive surfactants, anionic perborate, percarbonate and peracid bleaches, and the like. Alternatively, if the cation $X^+$ of the conventional active agent in the salt form of the formula $X^+Y^-$ provides the desired benefit activity, then the cationic form of the active agent is employed in the ionic liquid active. Examples of suitable cationic actives include, but are not limited to, cationic quaternary ammonium antimicrobial agents, cationic quaternary ammonium fabric softeners, and the like. As one of ordinary skill in the art will appreciate, a conventional nonionic or zwitterionic active agent can also be converted to an ionic liquid active by ionic functionalization.

In some embodiments, the ionic active is formed from known active agents which are insoluble or exhibit low solubility when employed in conventional cleaning compositions. Ionic liquids containing one or more ionic actives are disclosed in further detail in the co-filed P&G case 9815P.

In some embodiments, ionic liquids (undiluted with adjuncts, co-solvents or free water) employed herein have viscosities of less than about 2000 mPa·s, preferably less than about 750 mPa·s, as measured at 20° C. In some embodiments, the viscosity of undiluted ionic liquids are in the range from about 0.1 to about 500 mPa·s, preferably from about 0.5 to about 300 mPa·s, and more preferably from about 1 to about 250 mPa·s.

The cleaning compositions may be formulated in the form of liquid, gel, paste, foam, or solid. When the composition is in a solid form, it can be further processed into granules, powders, tablets, or bars. In a specific embodiment, the multiphasic composition is in the form of a liquid. The multiphasic composition of the present invention has a viscosity less than about 5000 mPa·s. In another embodiments, the viscosity of such composition is less than about 2000 mPa·s at room temperature (about 20° C.). In still another embodiment, the viscosity of such composition lowers to less than about 2000 mPa·s, preferably less than about 500 mPa·s, and more preferably less than about 250 mPa·s, when heated to a temperature in the range of about 40° C. to 60° C.

The viscosities of the ionic liquids and compositions containing them can be measured on a Brookfield viscometer model number LVDVII+ at 20° C., with spindle no. S31, at the appropriate speed to measure materials of different viscosities. Typically, the measurement is done at a speed of 12 rpm to measure products of viscosity greater than about 1000 mPa·s; 30 rpm to measure products with viscosities between about 500 mPa·s to about 1000 mPa·s; and 60 rpm to measure products with viscosities less than about 500 mPa·s. The undiluted state is prepared by storing the ionic liquids or cocktails in a desiccator containing a desiccant (e.g. calcium chloride) at room temperature for at least about 48 hours prior to the viscosity measurement. This equilibration period unifies the amount of innate water in the undiluted ionic liquid samples.

In a further embodiment, the cleaning compositions according to the present invention may comprise a third phase and optionally, further additional phases. In a specific embodiment, the cleaning composition comprises a third phase which separates from the first phase and the second phase upon standing of the composition, for example for a period of five minutes or more, and comprises an organic solvent, an ionic liquid, or mixtures thereof.

In preferred embodiments, the compositions according to the present invention are phase-stable over a range of operating conditions. For example, in one embodiment, the compositions are phase stable at temperatures ranging from about room temperature up to about 100° C.

The compositions of the present invention may be provided in various forms, including, but not limited to, hand dishwashing detergents, automatic dishwashing detergents, pretreating compositions, hand laundry detergents, automatic laundry detergents, and the like. The compositions may be formulated in the form of liquid, gel, paste, foam, or solid. When the composition is in the solid form, it can be further processed into granules, powders, tablets, or bars. The composition may be employed as a component of another cleaning product, for example by application to an absorbent substrate to provide a wipe for use in various applications. Any suitable absorbent substrate may be employed, including woven or nonwoven fibrous webs and/or foam webs. It is preferred that such an absorbent substrate should have sufficient wet strength to hold an effective amount of the composition according to the present invention to facilitate cleaning. The ionic liquid-containing composition can also be included in unit dose products, which typically employ a composition of the present invention in a unit dose package comprising a water soluble polymer film. Exemplary unit dose package are disclosed in U.S. Pat. No. 4,973,416; U.S. Pat. No. 6,451,750; U.S. Pat. No. 6,448,212; and US 2003/0,054,966A1.

To facilitate provision of a hand-washing composition, in one embodiment it is preferred that the composition is high-foaming. It should therefore be insured that the second ionic liquid phase does not inhibit foam formation or duration significantly. On the other hand, to facilitate provision of automatic washing detergents in another embodiment, it is preferred that such compositions are low-foaming to avoid foam formation which is typically unmanageable in automatic washing machines. Thus, such compositions may advantageously further include a suds suppressant. The compositions may be provided for use in any desirable form, including unit dose form.

The method of forming the multiphasic composition of the present invention comprises the steps of: providing a first liquid comprising an ionic liquid, a second liquid comprising a carrier, and a surfactant capable of stabilizing the phases; and combining the first and second liquids and the surfactant under a shear rate of at least about 10,000 $s^{-1}$ for at least about 30 seconds, thereby forming a composition capable of forming into a multiphase composition. Alternatively, the high shear mixing step may be conducted at a shear rate of from about 13,000 to about 30,000 $s^{-1}$, and the duration may range from at least about 1 minute, or at least about 5 minutes, or at least about 30 minutes. Adjunct ingredients may be combined into the multiphase composition concurrent or subsequent to the mixing operation.

The methods according to the invention provide cleaning of a surface by use of the compositions as described herein. Typically, a soiled surface is contacted with a wash liquor comprising the cleaning composition of the invention. The wash liquor may be a neat form of the cleaning composition, or may comprise a diluted solution of the cleaning composition (typical cleaning composition to water ration is 1:100 or higher). As will be recognized, in hand and automatic dish and laundry washing applications, the cleaning composition will be diluted with water.

EXAMPLES

The following are nonlimiting examples of multiphase aqueous consumer product compositions containing ionic liquids (amounts are in weight percentages).

| | Component | | | | |
|---|---|---|---|---|---|
| | 1 | 2 | 3 | 4 | 5 |
| Ionic Liquid 1 (Trioctyl methyl amine-Dioctyl Sulfosuccinate) | — | 5 | — | — | — |
| Ionic Liquid 2 (Triisooctyl methyl amine-$C_{12-13}$ methyl branched dodecyl sulfate) | 10 | — | — | — | 60 |
| Ionic Liquid 3 (Tetraoctyl amine-Dodecyl sulfate) | — | — | 20 | 2 | — |
| Aesthetic Agents[1] | 1 | 1 | 1 | 1 | 1 |
| Enzymes[2] | 2 | — | — | 1 | — |
| Adjuncts[3] | 40 | 30 | 10 | 25 | 5 |
| Co-solvent[4] | — | 5 | 2 | — | 15 |
| Phase stabilizing surfactants[5] | 0.5 | 1 | 0 | 2 | 3 |
| Water | balance | balance | balance | balance | balance |

[1]Exemplary Aesthetic Agents include dyes, colorants, speckles, perfumes and mixtures thereof.
[2]Exemplary Enzymes include proteases, amylases, lipases, and mixtures thereof, and the like.
[3]Exemplary Adjuncts include surfactants, soil dispersing agents, bleaching agents, preservatives and mixtures thereof, and the like.
[4]Exemplary Co-solvents include ethanol, isopropanol, propylene glycol, and mixtures thereof.
[5]Exemplary phase stabilizing surfactants include decaglycerol decaoleate, sorbitan esters (Span ® from Uniqema), polyoxyethylene derivatives of sorbitan esters (Tween ® from Uniqema), and block copolymer surfactants (Pluronic ® from BASF Corporation).

The ionic liquids employed in these examples can be prepared according to the methods disclosed in the co-filed U.S. patent applications 60/624,056 and 60/624,125 (P&G case 9817P and 9818P).

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multiphase cleaning composition, comprising a first phase comprising a carrier and a second phase comprising an ionic liquid consisting of:

a) an amine oxide cation having the formula:

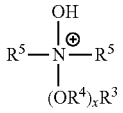

wherein $R^3$ is an $C_{8-22}$ alkyl, $C_{8-22}$ hydroxyalkyl, $C_{8-22}$ alkyl phenyl group, and mixtures thereof; $R^4$ is an $C_{2-3}$ alkylene or $C_{2-3}$ hydroxyalkylene group or mixtures thereof; x is from 0 to about 3; and each $R^5$ is an $C_{1-3}$ alkyl or $C_{1-3}$ hydroxyalkyl group or a polyethylene oxide group containing an average of from about 1 to about 3 ethylene oxide groups; or the $R^5$ groups are attached to each other, through an oxygen or nitrogen atom, to form a ring structure; and b) an anion selected from a group consisting of alkyl aryl sulfonates, mid-chain branched alkyl sulfates, mid-chain branched alkyl aryl sulfonates and mid-chain branched alkyl polyoxyalkyene sulfates;

wherein the second phase is substantially immiscible with the first phase.

2. The composition of claim 1, wherein the first phase is an aqueous phase.

3. The composition of claim 1, wherein the first phase comprises a silicone solvent system.

4. The composition of claim 1, further comprising a third phase which separates from the first phase and the second phase upon standing, and comprises an organic solvent, an ionic liquid, or mixtures thereof.

5. The composition of claim 1, wherein the second phase comprises from about 0.01 to about 90 weight % of the composition.

6. The composition of claim 1, wherein the second phase comprises less than about 50 weight % of the composition.

7. The composition of claim 1, wherein the first phase is the continuous phase and the second phase is the dispersed phase.

8. The composition of claim 7, wherein the dispersed second phase comprises droplets having an average droplet size of less than about 1,000 microns.

9. The composition of claim 1, wherein the composition is phase stable at a temperature of less than about 70° C., and/or a pH of from about 3 to about 12.

10. The composition of claim 1, further comprising a phase stabilizing surfactant.

11. The composition of claim 1, further comprising a soil dispersing agent selected from the group consisting of clays, polymers, surfactants, and mixtures thereof.

12. The composition of claim 1, further comprising a benefit agent selected from the group consisting of bleaches, bleach catalysts, bleach boosters, bleach activators, suds suppressors, builders, chelants, biocides, surfactants, enzymes, radical initiators, perfumes, dyes, skin conditioning actives, vitamins, softeners, and mixtures thereof.

13. The composition of claim 12, wherein the benefit agent is associated with the second phase.

14. The composition of claim 1, wherein the composition is a hand dishwashing detergent, an automatic dishwashing detergent, a pretreating composition, or a laundry detergent.

15. A method of forming a multiphasic composition comprising the steps of:

(a) providing a first liquid comprising an ionic liquid consisting of:

1) an amine oxide cation having the formula:

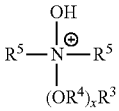

wherein $R^3$ is an $C_{8-22}$ alkyl, $C_{8-22}$ hydroxyalkyl, $C_{8-22}$ alkyl phenyl group, and mixtures thereof; $R^4$ is an $C_{2-3}$ alkylene or $C_{2-3}$ hydroxyalkylene group or mixtures thereof; x is from 0 to about 3; and each $R^5$ is an $C_{1-3}$ alkyl or $C_{1-3}$ hydroxyalkyl group or a polyethylene oxide group containing an average of from about 1 to about 3 ethylene oxide groups; or the $R^5$ groups are attached to each other, through an oxygen or nitrogen atom, to form a ring structure; and 2) an anion selected from a group consisting of alkyl aryl sulfonates, mid-chain branched alkyl sulfates, mid-chain branched alkyl aryl sulfonates and mid-chain branched alkyl polyoxyalkyene sulfates;

a second liquid comprising a carrier, and a surfactant; and (b) combining the first and second liquids and the surfactant under a shear rate of at least about 10,000 $s^{-1}$ for at least about 30 seconds, thereby forming a composition capable of phase separation into a multiphasic composition.

16. The method of claim 15, further comprising the steps of providing optional adjunct ingredients and combining the adjunct ingredients into the composition concurrent with or after step (b).

* * * * *